US011407096B2

(12) United States Patent
Bousquet

(10) Patent No.: US 11,407,096 B2
(45) Date of Patent: Aug. 9, 2022

(54) MULTI-PURPOSE TOOL AND ATTACHMENTS

(71) Applicant: Glen Bousquet, West Boylston, MA (US)

(72) Inventor: Glen Bousquet, West Boylston, MA (US)

( * ) Notice: Subject to any disclaimer, the term of this patent is extended or adjusted under 35 U.S.C. 154(b) by 301 days.

(21) Appl. No.: 16/524,255

(22) Filed: Jul. 29, 2019

(65) Prior Publication Data

US 2021/0031353 A1 Feb. 4, 2021

(51) Int. Cl.

| | |
|---|---|
| ***B25F 1/02*** | (2006.01) |
| ***B44D 3/16*** | (2006.01) |
| ***A46B 15/00*** | (2006.01) |
| *B66F 15/00* | (2006.01) |

(52) U.S. Cl.

CPC ..... *B25F 1/02* (2013.01); *A46B 15/0055* (2013.01); *A46B 15/0081* (2013.01); *B44D 3/162* (2013.01); *B66F 15/00* (2013.01)

(58) Field of Classification Search

CPC ... B25F 1/02; B25F 1/00; B44D 3/162; B66F 15/00; A46B 15/0079; A46B 15/0055; A46B 15/0081; A46B 15/0065; A46B 15/0093; F41A 29/00; F41A 29/02

USPC ..... 15/105, 111, 113; 7/159, 161; D4/118

See application file for complete search history.

(56) References Cited

U.S. PATENT DOCUMENTS

| | | | | |
|---|---|---|---|---|
| 1,598,420 | A * | 8/1926 | Brossett | B25F 1/04 7/105 |
| 2,715,750 | A * | 8/1955 | Vail | B44D 3/105 15/105 |
| 3,858,258 | A | 1/1975 | Stevens | |
| 5,027,512 | A | 7/1991 | Andrews | |
| 5,809,600 | A | 9/1998 | Cachot | |
| 5,810,408 | A | 9/1998 | Armstrong | |
| 6,009,581 | A | 1/2000 | Davis et al. | |
| D443,015 | S * | 5/2001 | Abdo | D22/108 |
| 6,257,553 | B1 * | 7/2001 | Khachatoorian | B66F 15/00 254/21 |
| 6,983,506 | B1 | 1/2006 | Brown | |
| 7,340,984 | B2 | 3/2008 | Hsieh | |
| 7,779,500 | B1 | 8/2010 | Greer | |
| 8,205,341 | B2 * | 6/2012 | Rosso | E04F 21/1652 30/169 |
| 8,667,636 | B2 * | 3/2014 | Berney | E04F 21/163 15/105.5 |
| D772,373 | S * | 11/2016 | Calbi | D22/199 |
| 9,591,809 | B2 | 3/2017 | Gieske et al. | |
| 9,707,676 | B2 | 7/2017 | Chapman | |
| 9,775,271 | B2 | 10/2017 | Bartnik | |
| 10,058,988 | B1 * | 8/2018 | Pintal | A46B 15/0081 |

(Continued)

FOREIGN PATENT DOCUMENTS

| | | | | |
|---|---|---|---|---|
| CA | 2 296 048 | A1 | 7/2001 | |
| GB | 2136340 | A * | 9/1984 | A47L 13/08 |
| WO | 0196073 | A1 | 12/2001 | |

*Primary Examiner* — Laura C Guidotti

(74) *Attorney, Agent, or Firm* — Lambert Shortell & Connaughton; David J. Connaughton, Jr.; Justin P. Tinger

(57) ABSTRACT

A handheld multi-tool is provided. The tool has an elongate central handle with an integrally formed tool at each opposite end of the handle. A plurality of additional tools may be attached to the multi-tool by slideably fitting over one of the integrally formed tools, leading to a wide variety of operational modes for the multi-tool.

14 Claims, 4 Drawing Sheets

(56) References Cited

U.S. PATENT DOCUMENTS

| | | | | |
|---|---|---|---|---|
| 2007/0226913 | A1* | 10/2007 | Woolley | E04G 23/082 7/146 |
| 2010/0263219 | A1 | 10/2010 | Kempker et al. | |
| 2011/0138540 | A1 | 6/2011 | Kinskey et al. | |
| 2012/0098282 | A1 | 4/2012 | Langan | |
| 2012/0227267 | A1 | 9/2012 | Qiu | |
| 2015/0209953 | A1 | 7/2015 | Klecker | |
| 2016/0176036 | A1 | 6/2016 | Langan | |
| 2018/0255693 | A1* | 9/2018 | Bonner | B26B 11/006 |

* cited by examiner

MULTI-PURPOSE TOOL AND ATTACHMENTS

BACKGROUND OF THE INVENTION

Field of the Invention

The present invention relates generally to tool devices. More particularly the present invention relates to a handheld tool with multiple different functions.

Description of Related Art

Projects such as painting, woodworking, auto-body work, general maintenance, and other related tasks require a large selection of tools. These tools can be bulky, difficult to get into tight spaces, and generally perform only one task when used. When performing a typical task, it is common for a number of different tools to be required. This often means bringing a large number of tools, and spending time searching for and switching out which tools are being used. Moreover, such a wide variety of tools requires a great deal of storage space.

Therefore, what is needed is a compact and multi-purpose tool.

SUMMARY OF THE INVENTION

The subject matter of this application may involve, in some cases, interrelated products, alternative solutions to a particular problem, and/or a plurality of different uses of a single system or article.

In one aspect, a handheld multi-tool is provided. The multi-tool is formed of an elongate central handle, with a first tool at a first end, and a second tool at a second, opposite end. The first tool has a flat profile and being angled at an obtuse angle with respect to a major axis of the central handle. The second tool has a flat profile and being angled at an obtuse angle with respect to the major axis of the central handle opposite to the first side.

In another aspect, handheld multi-tool kit is provided. The kit has multi-tool is formed of an elongate central handle, with a first tool at a first end, and a second tool at a second, opposite end. The first tool has a flat profile and being angled at an obtuse angle with respect to a major axis of the central handle. The second tool has a flat profile and being angled at an obtuse angle with respect to the major axis of the central handle opposite to the first side. Also included in the kit are a plurality of tools. Each of the tools is attachable to at least one of the first tool and the second tool by an aperture which is sized to be frictionally fit over the flat profile of at least one of the first tool and the second tool.

DETAILED DESCRIPTION

Figure 1:
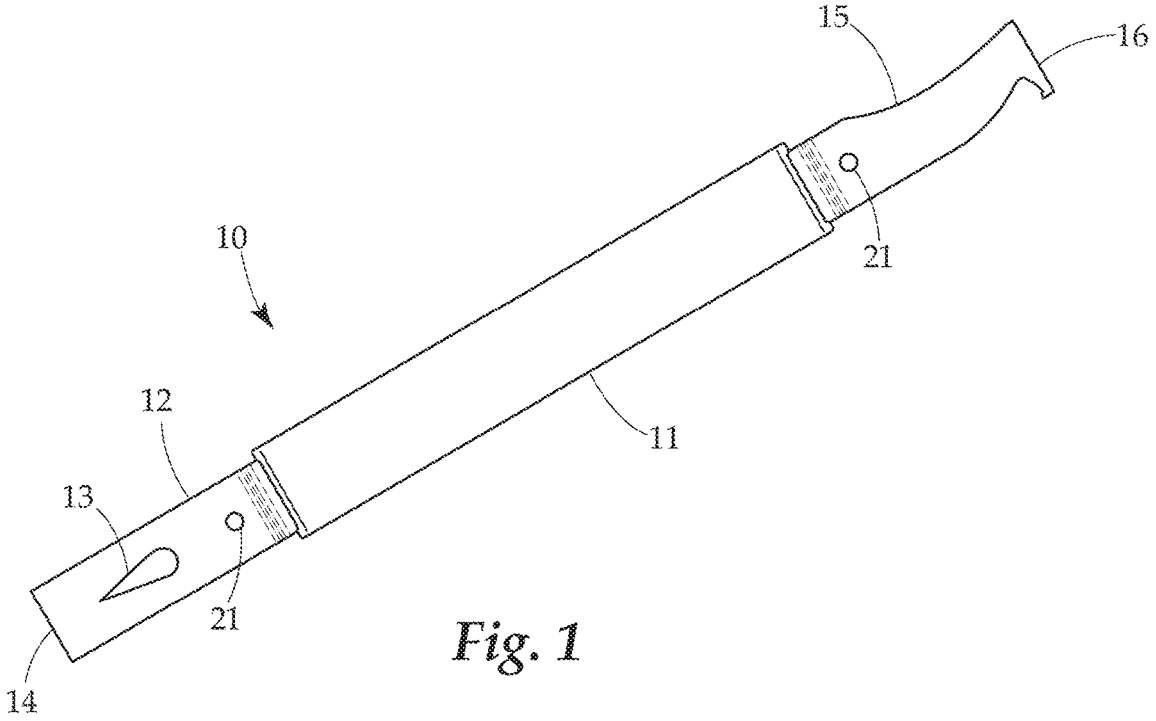
FIG. 1 provides an elevation view of an embodiment of the multi-tool.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a multi-tool which has at least one, preferably two, integrally formed tools extending from opposite ends of an elongate central handle. The two tools extend from the handle, in most embodiments, are angled away from a major axis of the central handle to provide mechanical advantage as well as balance and ergonomic operation. In a particular embodiment having two tools extending from opposite sides of the handle, the tools may be bent in opposite directions at opposite oblique angles relative to the major axis of the central handle. The tools on the ends of the handle have a flat and typically approximately rectangular profile. Onto these tools, other secondary tools may be attached by sliding over the flat profile. This allows the multi-tool to have a plethora of operational modes depending which secondary tools are attached to the multi-tool. Attachment may be by frictional connection, snap fit, or any other arrangement.

In one embodiment, the multi-tool may be formed of a metal, such that the first and second tools extending from the handle are metal, as is the multi tool handle. In a further embodiment, a plastic, rubber, or similar polymeric material may cover the central handle providing comfort and easy gripping to a user. However, it should be understood that the present invention is not limited to any particular materials. In a particular embodiment, the multi-tool may be made of a spring steel or other metal having a very high yield strength, so that upon the application of force to the tool, it will return to its original shape rather than being permanently bent. Even in these embodiments however, the material of the multi-tool will be quite stiff allowing for leverage to be applied to it to provide mechanical advantage in operation.

In one embodiment, the tool may have a length of approximately 10-12 inches, a thickness of approximately 0.0625 inches, and a width of approximately 0.75 inches. The tools extending from the handle portion extend approximately 2 to 2.5 inches from each end, and bend approximately 23 degrees in opposite directions. In a further particular embodiment, the ends of the handle at the tool area may have material removed to produce beveled, curved, hooked, and/or teardrop geometries. Of course, size may vary without straying from the scope of this invention.

In a further embodiment, a plastic, rubber, or similar polymeric material may cover the central handle providing for comfort and easy gripping to a user. This material may surround, partially or completely, the metal or other base material of the multi-tool. In a particular embodiment, the selected covering material may be chemical and solvent resistant. In a further particular embodiment, the handle may be coated with a layer or layers of polymeric wrap that may be heat-shrunk to encapsulate the central handle.

Any number of different secondary tools may be employed, each of which can be attached over one of the first and/or second tools. Typically, any secondary tool comprises an aperture formed as a channel which approximately corresponds to the profile of one or both of the first and second tools. As such, the secondary tool can fit over the first/second tool by sliding on and off, and can be manipulated by a user holding the handle. In some embodiments, the aperture may be bounded by an insert so as to form a barrier between the secondary tool and the first/second tool. The insert may provide a tight frictional fit and be formed of a resilient material like metal or plastic for repeated sliding connection and removal. In certain embodiments, the secondary tools may have a hole, slot, or protrusion on a top or bottom portion which can engage with a bump, slot, or protrusion on a face of the first or second tool, or on the central body. This bump and hole embodiment allows for a snap-fit connection of the secondary tool to the body and guides proper positioning of the secondary tool.

The built-in first and second tools may vary depending on embodiment. In some embodiments, they may be the same tools, while in other embodiments, they may be different tools. In one embodiment, one of the tools may be a scraper. In another embodiment, one of the tools may be a pry bar. In yet another embodiment, one of the tools may be a hook. In yet other embodiments, the tools may have multiple components, such as a sharpened leading edge (for scraping and/or as a chisel), a partial hook shape (for manipulation and grabbing, as well as fine scraping), and may be formed of a sufficiently rigid material to work as a pry bar.

The secondary tools attachable over the first and/or second built-in tools may be any tool capable of attaching to the tool. For example, secondary tools may include, but are not limited to: a sanding block, paint brush or pad, hook, razor scraper, putty knife, paint roller attachment, and the like.

In various embodiment, the present invention may be embodied as the tool itself, as well as a kit comprising the tool as well as a plurality of secondary tools attachable to the built in tool components.

Figure 2:
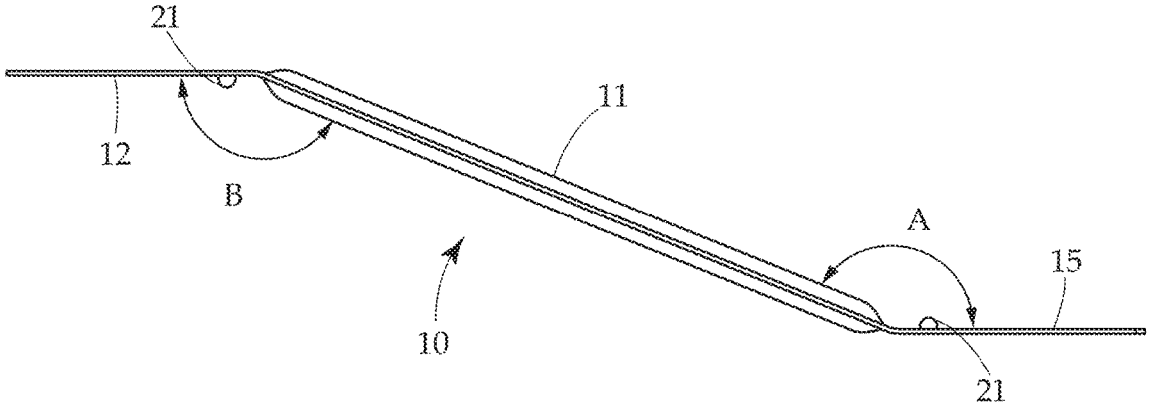
FIG. 2 provides a side view of another embodiment of the multi-tool.

Turning now to FIGS. 1 and 2, elevation and side views of an embodiment of the multi-tool re shown. The tool 10 has an elongate central handle 11 with a first tool 12 extending from a first end of the handle 11 and a second tool 15 extending from a second opposite end of the handle. Each tool 12, 15 has a flat profile (best seen in FIG. 2) and is angled at an obtuse angle A with respect to a major axis of the handle 11. In the embodiment shown, the first and second tools 12, 15 are oppositely angled from the body, which creates a balance in weight and orientation. However, other angled arrangements are possible depending on embodiment. The first tool 12 is shown in this embodiment as a pry bar, which may also be used as a chisel and scraper by way of a sharpened leading edge 14. The first tool 12 further comprises a nail puller 13 formed as a teardrop shaped aperture. The second tool 15 is shown in this embodiment as a hook. This tool also has a sharpened leading edge 16 allowing it to work as a scraper as well. The hook shape allows the tool 15 to provide fine scraping and manipulation. Bump 21 extends from a surface of the first and second tools 12, 15. In FIG. 1, bump 21 is on the same side of the tools, and in FIG. 2 bump 21 is on opposite sides. In other embodiments, bump 21 may be on both top and bottom sides of the tools 12, 15. Bump is formed to engage with a corresponding hole or dimple on a secondary tool to allow a snap fit of the secondary tool to the handle 11 by way of connecting over one of the first or second tools 12, 15.

Figure 3:
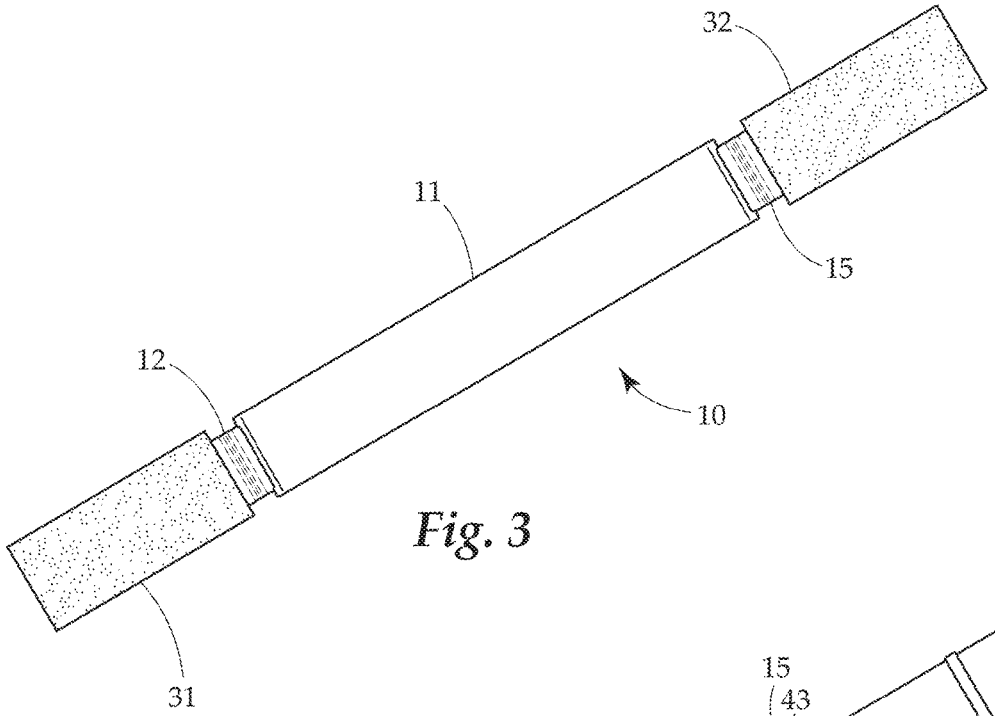
FIG. 3 provides an elevation view of an embodiment of the multi-tool having sanding pads attached to each end.

FIG. 3 shows an embodiment of the tool having secondary tools attached. In this view, a third tool 31 formed as a sanding block is attached over the first tool 12. The third tool 31 has an aperture approximately corresponding in shape to the flat profile of the first tool 12. A similar arrangement is seen with the fourth tool 32 formed as a sanding block attached over the second tool 15.

Figure 4:
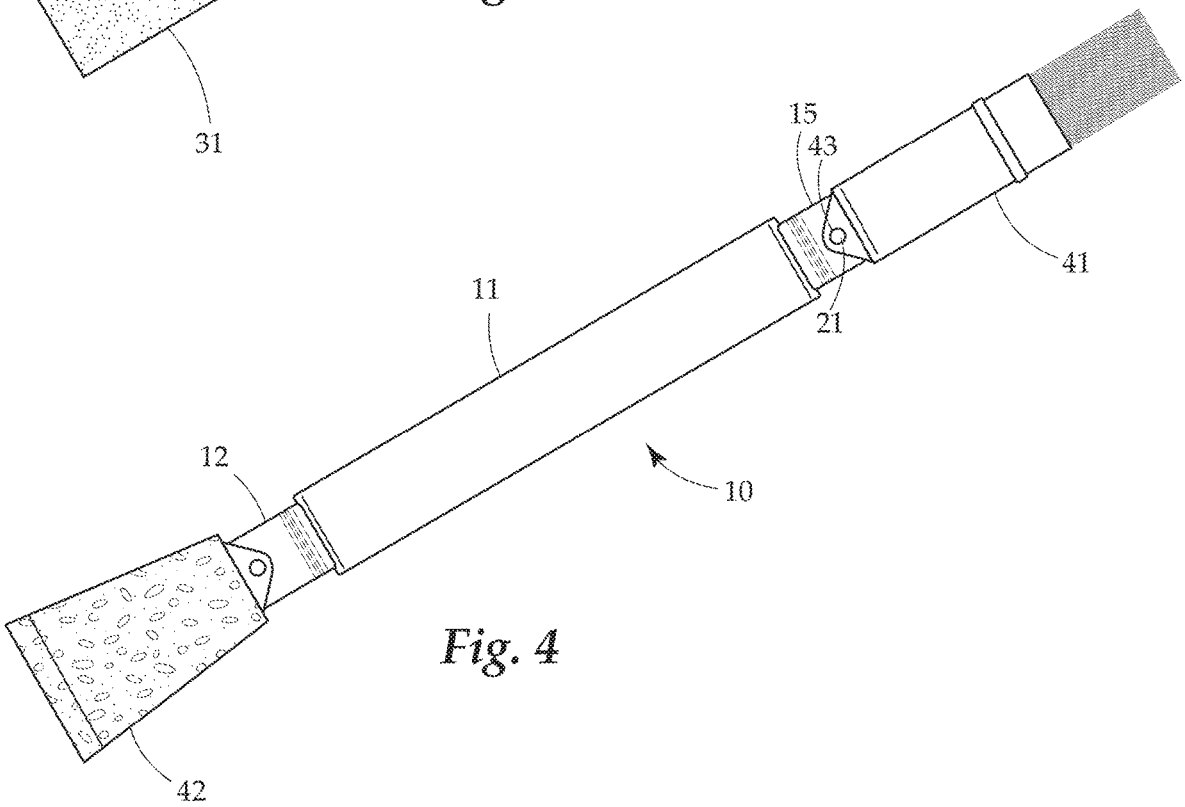
FIG. 4 provides an elevation view of an embodiment of the multi-tool having painting tools attached to each end.

FIG. 4 shows another embodiment of the tool having secondary tools attached. In this view, a third tool 42 formed as a foam paint brush/pad is attached over the first tool 12. As in FIG. 3, third tool 42 has an aperture approximately corresponding in shape to the flat profile of the first tool 12. In addition, third tool 42 includes a tab which protrudes from its distal end, the tab defines a hole 43 which is engaged with bump 21. The hole 43 for engagement with bump 21, in this or any other embodiment, can also be used to hang the secondary tool when not in use. Of course, if the hole 43 is instead formed as a dimple, hanging is less convenient but is still within the scope of the present invention. This optional arrangement allows proper positioning, and in some cases orientation of the third tool 42 over the first tool 12. The bump and hole arrangement also allows for a snap fit connection which in some cases may be more desirable than, or supplemental to, a frictional connection between the tool aperture and the first tool 12. It should be understood that this functionality and operation of the hole 43 for engagement with bump 21 applies to any secondary tool. A similar arrangement is seen with the fourth tool 41 formed as a bristle paint brush attached over the second tool 15. Fourth tool 41 also has a tab extending from its distal end which defines a hole 43 which is engaged with bump 21. While two tools are shown attached in FIGS. 3 and 4, it should be understood that only one secondary tool may be attached to one of the first and second tool.

Figure 5:
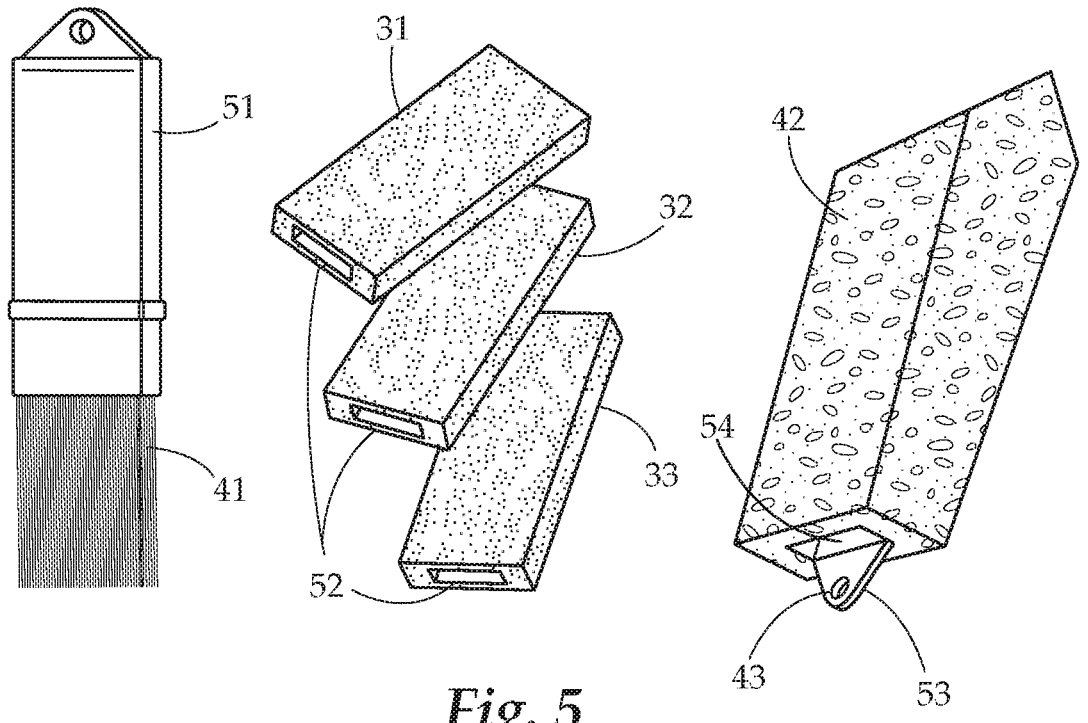
FIG. 5 provides views of various embodiments of tools which can be attached to the multi-tool.

FIG. 5 provides a view of various embodiments of secondary tools which can be attached to the multi-tool. Bristle brush 41 can be seen with the bristles extending from body 51. Body 51 defines the aperture which allows connection to one or both of the first and second tool 12, 15. Similarly, sanding pads of different grit 31, 32, 33 are shown. Each sanding pad 31, 32, 33 has an aperture 52 which forms the channel allowing the attachment with the first and/or second tool. A similar shaped opening can be found in any of the secondary tools. Paint brush pad 42 is also shown having aperture 54 for connection to the first and/or second tool. Tab 53 defines hole 43 for a snap fit connection to a bump on the first or second tool surface.

Figure 6:
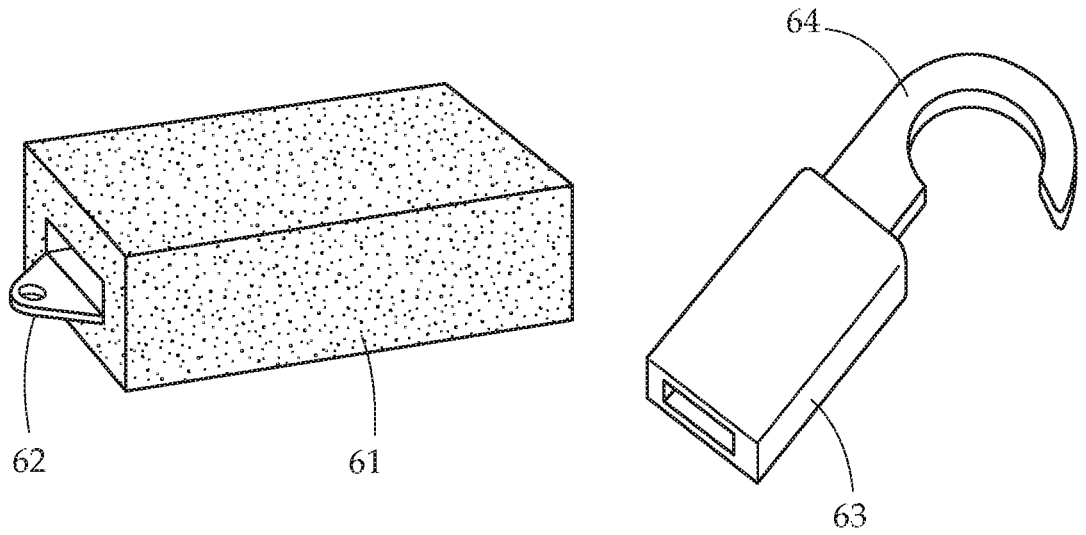
FIG. 6 provides views of various additional embodiments of tools which can be attached to the multi-tool.

FIG. 6 provides a view of various embodiments of secondary tools which can be attached to the multi-tool. A large sanding block 61 is shown having an aperture which forms the channel allowing connection with the first and/or second tool. Tab 62 defines hole 43 for a snap fit connection to a bump on the first or second tool surface. Hook tool is formed of a metal hook 64 and a body 63 which defines the aperture for connection to the first and/or second tool.

Figure 7:
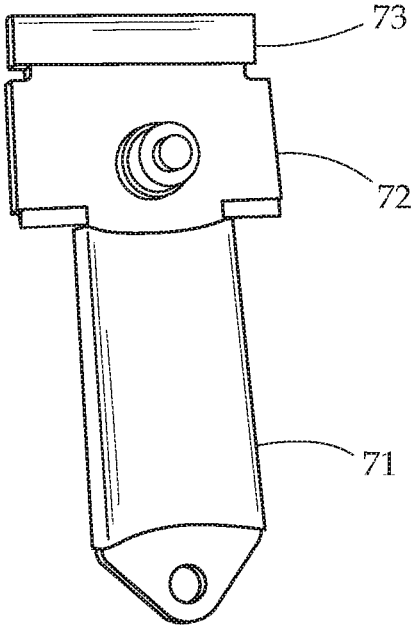
FIG. 7 provides a view of a razor blade assembly for an embodiment of the multi-tool.

FIG. 7 provides a view of a razor blade assembly embodiment of the multi-tool. The razor blade assembly includes a base 71 for connection to one or both of the first and second tools. The base 71 defines an aperture (not shown) as well as having a tab with a hole for engagement to the bump 21 of the first or second tool. A razor holder 72 allows removable connection of razor 73 so that as the razor 73 dulls, it can be replaced.

Figure 8:
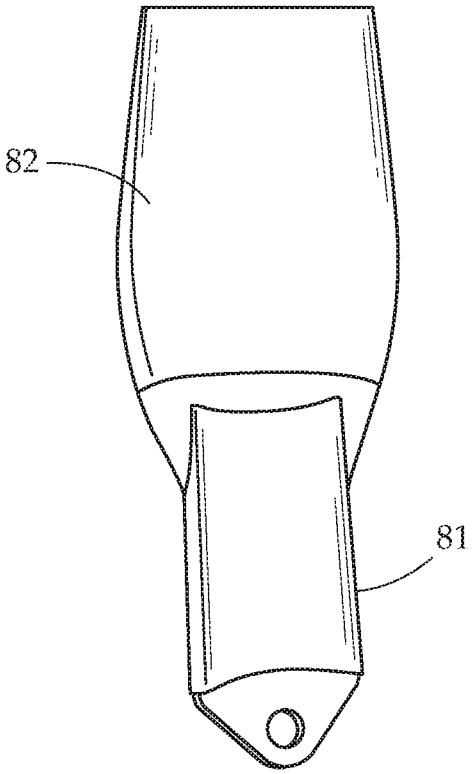
FIG. 8 provides a view of a putty knife tool attachment for an embodiment of the multi-tool.

FIG. 8 provides a view of a putty knife tool attachment embodiment of the multi-tool. The putty knife tool includes the putty knife 82 as well as base 81. Base 81 defines an aperture (not shown) as well as having a tab with a hole for engagement to the bump 21 of the first or second tool.

Figure 9:
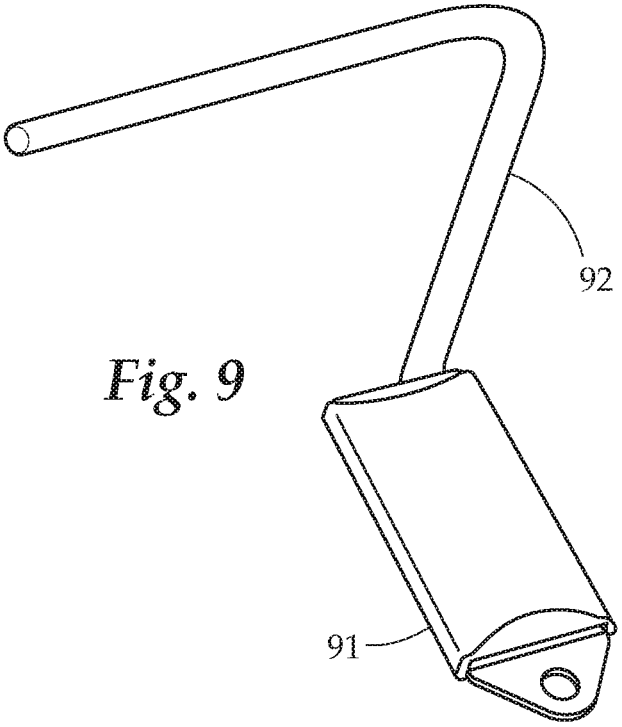
FIG. 9 provides a view of a paint roller tool attachment for an embodiment of the multi-tool.

FIG. 9 provides a view of a paint roller tool attachment embodiment of the multi-tool. The paint roller tool includes the paint roller stem 92 shaped and sized to receive a paint roller and/or mini paint roller roll. The attachment also has base 91. Base 91 defines an aperture (not shown) as well as having a tab with a hole for engagement to the bump 21 of the first or second tool.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A handheld multi-tool comprising:

an elongate central handle;

a first tool at a first end of the central handle, the first tool having a flat profile and being angled at an obtuse angle with respect to a major axis of the central handle;

a second tool at a second opposite end of the central handle, the second tool having a flat profile and being angled at an obtuse angle with respect to the major axis of the central handle;

wherein the first tool and the second tool are angled on opposite sides of the major axis of the central handle;

wherein the first tool is a scraper comprising a beveled end;

wherein the second tool is a hook;

wherein the second tool further comprises a curved surface; and wherein the scraper further comprises a tear-drop shaped aperture operable as a nail-puller.

2. A handheld multi-tool comprising:

an elongate central handle;

a first tool at a first end of the central handle, the first tool having a flat profile and being angled at an obtuse angle with respect to a major axis of the central handle;

a second tool at a second opposite end of the central handle, the second tool having a flat profile and being angled at an obtuse angle with respect to the major axis of the central handle;

wherein the first tool and the second tool are angled on opposite sides of the major axis of the central handle; and further comprising a third tool attached over the first tool, the third tool defining an aperture sized to be frictionally fit over the flat profile of the first tool, the first tool positioned within the aperture.

3. The handheld multi-tool of claim 2 further comprising a fourth tool attached over the second tool, the fourth tool defining an aperture sized to be frictionally fit over the flat profile of the second tool, the second tool positioned within the aperture of the fourth tool.

4. The handheld multi-tool of claim 3 wherein the fourth tool is a foam paintbrush.

5. The handheld multi-tool of claim 2 wherein the first tool comprises a bump on an outer surface, the bump engaged with a hole at a distal end of the third tool thereby holding the third tool in place and guiding a proper placement of the third tool over the first tool.

6. The handheld multi-tool of claim 2 wherein the third tool is a sanding block.

7. The handheld multi-tool of claim 2 wherein the third tool is a paintbrush.

8. The handheld multi-tool of claim 2 wherein the third tool is a metal hook.

9. The handheld multi-tool of claim 2 wherein the third tool is a razor assembly having a removable razor blade.

10. The handheld multi-tool of claim 2 wherein the third tool is a putty knife.

11. The handheld multi-tool of claim 2 wherein the third tool comprises an insert bounding the aperture, the insert being formed of a separate material from the third tool.

12. A handheld multi-tool kit comprising:

a handheld tool comprising:

an elongate central handle;

a first tool formed as a scraper having a sharpened distal end at a first end of the central handle, the first tool having a flat profile and being angled at an obtuse angle with respect to a first side of the central handle, the first tool further comprising a tear-drop shaped aperture operable as a nail-puller; and a second tool at a second opposite end of the central handle, the second tool having a flat profile and being angled at an obtuse angle with respect to a second side of the central handle opposite to the first side; and a plurality of tools, each of the tools attachable to at least one of the first tool and the second tool by an aperture in each of the plurality of tools which is sized to be frictionally fit over the flat profile of at least one of the first tool and the second tool; and wherein the plurality of tools comprises a sanding block, and a paintbrush.

13. The handheld multi-tool kit of claim 12 wherein the elongate central handle comprises an inner metal layer having a flat profile, and a plastic outer layer at least partially covering the inner metal layer.

14. The handheld multi-tool kit of claim 12 wherein the first tool is of a same size and profile as the second tool.

* * * * *